United States Patent [19]

Thompson

[11] 4,384,417

[45] May 24, 1983

[54] INDEX TAB CLIP FOR SHEET MATERIAL

[76] Inventor: Edward W. Thompson, W. 3614 Rockwell, Spokane, Wash. 99205

[21] Appl. No.: 302,625

[22] Filed: Sep. 15, 1981

[51] Int. Cl.[3] ..... G09F 3/18

[52] U.S. Cl. ..... 40/11 A; 40/23 A

[58] Field of Search ..... 40/11 A, 23 A, 360; 281/42

[56] References Cited

U.S. PATENT DOCUMENTS

| | | | |
|---|---|---|---|
| 1,584,238 | 5/1926 | Menger | 40/360 |
| 1,914,671 | 6/1933 | O'Neil | 40/23 A |
| 2,415,248 | 2/1947 | Kenna et al. | 40/23 A |
| 3,123,924 | 3/1964 | Roberts | 40/11 A |
| 3,425,389 | 2/1969 | Sacco et al. | 281/42 |
| 4,286,358 | 9/1981 | Levin | 40/11 A |

*Primary Examiner*—Gene Mancene
*Assistant Examiner*—Wenceslao J. Contreras
*Attorney, Agent, or Firm*—Keith S. Bergman

[57] ABSTRACT

An index tab and associated clip for releasable positioning about the periphery of sheet material. The tab provides a folded sheet-like body portion to releasably accept a retentently deformable paper clip to position the device about the periphery of a sheet-like element with the tab portion protruding substantially normally to the sheet periphery and the body portion extending on both sides of the sheet, between it and the paper clip. The protruding tab may be premarked or marked by a user.

6 Claims, 7 Drawing Figures

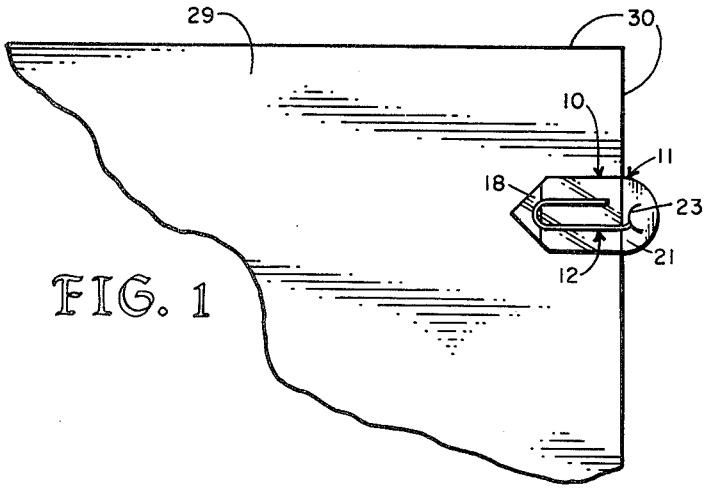
FIG. 1
FIG. 4
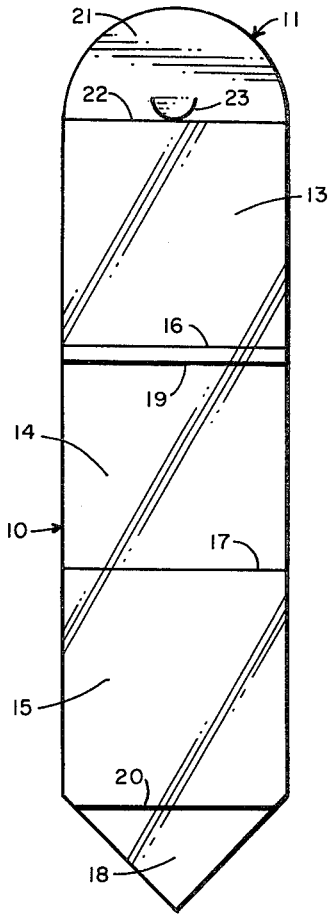
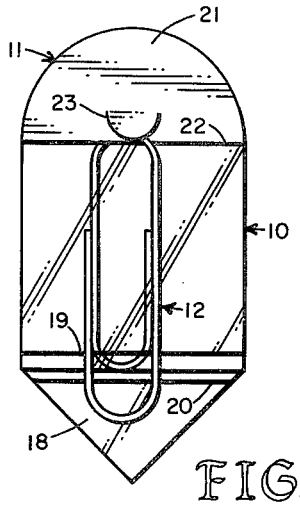
FIG. 2
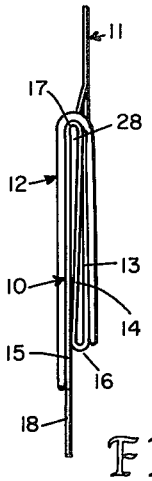
FIG. 3
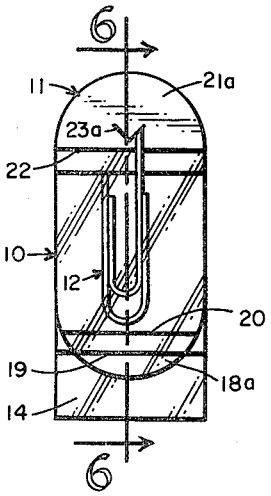
FIG. 5
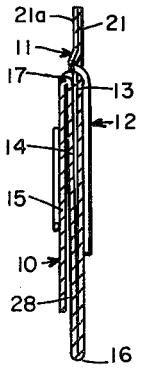
FIG. 6
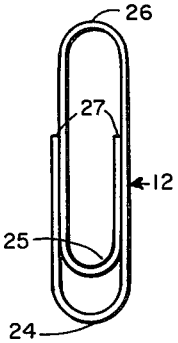
FIG. 7

INDEX TAB CLIP FOR SHEET MATERIAL

BACKGROUND OF INVENTION

1. Related Applications

There are no applications related hereto heretofore filed in this or any foreign country.

2. Field of Invention

This invention relates generally to index tabs and more particularly to such tabs that are releasably positionable on sheet material.

3. Description of Prior Art p It is oftentimes desirable, especially in the business arts, to have a small, inexpensive, indexing tab that may be releasably positioned about the periphery of paper or other sheet material to aid in its identification. This need has been long recognized and responsively many such devices have become known. The instant invention provides a new member of this group of devices.

Many such tabs heretofore known, and probably the original progenitors, were more or less fixedly positioned about the periphery of a sheet and these tabs generally were positioned, at least for any effective use on only one sheet. Such type of devices is epitomized by that described in the instant inventor's prior U.S. Pat. No. 3,463,515 issued Aug. 26, 1969. This type of tab structure is readily distinguishable from the instant species of index tab because of the fixed positioning of the former.

Releasably positionable indexing tabs having some sort of associated clip to accomplish releasable fastening on a sheet structure to be serviced have also become known. Such indexing tabs may be, for ease of consideration, divided into a first more complex class using a compound clip having hingably related movable parts and a second, more simple, class providing a rententently deformable clip of unitary structure such as the ordinary wire paper clip of present day commerce. The instant invention is of the latter class.

The instant invention is distinguished from the prior art by providing a semicircular protruding tab supported by a structurally integral body of some length that is folded upon itself to be positionable on both sides of a sheet to be serviced with a fastening clip positioned on the outer surfaces of the tab body so that the clip does not come into contact with the sheet being serviced. My structure allows simpler and easier insertion on and removal from the periphery of a sheet, as the traditional paper clip tends to gouge sheets, especially on removal when at least one end portion tends to engage a sheet because of its generally sharp edge and somewhat skewed positioning relative to the sheet. Again, the tab body of the instant invention provides a means for alignment and positioning of the structure upon a sheet, as one fold is parallel with and immediately adjacent the periphery of a sheet when the device is properly placed. The body structure of the instant tab also provides a strong semi-rigid element that does not so readily tear or have the potentiality for tearing as the periphery of a sheet being serviced because of its strength, its greater areal contact with a sheet than a paper clip by itself and because the semicircular tab has a somewhat curvilinear orientation where its periphery contacts the periphery of a serviced sheet. The body of my index tab may be made of transparent material so that the material underneath it may be read through the body and its inner portion may be particularly configured and marked to serve as a secondary indexing element at a spaced distance inwardly from the periphery of a sheet being serviced to designate positioning of printed lines or other physical things on the sheet. Because of its particular structure, the instant invention will tend to remain aligned in proper position on a sheet rather than skew or twist relative thereto as will most prior art devices. The size and shape of my device tend to allow it to be more readily manipulated for placement and removal, as the device itself tends to serve as somewhat of a handle for such purposes.

My invention thusly differs both structurally and functionally from the prior art, individually or in combination.

SUMMARY OF INVENTION

My invention in general provides an index tab having an integral elongate tab body extending therefrom and folded upon itself twice to form a pocket in which a peripheral portion of a sheet to be serviced may be inserted. A retentently deformable clip carried on both sides of the tab body creates mechanical bias to establish frictional forces that tend to positionally maintain the device once it is placed.

My tab comprises an elongate strip of foldable sheet material of a length several times its width. One end part is configured to a semi-circular shape to constitute the protruding index tab. The tab body is folded upon itself firstly toward the index tab and thence away from it to form a slot, opening away from the index tab, in which a sheet to be serviced may be positioned. A hole is provided in the index tab to accept an ordinary paper clip of commerce with half on each side of the tab body portion forming the sheet accepting pocket.

In providing such a device it is:

A principal object of my invention to provide a movable and reusable indexing tab, releasably positionable about the periphery of a sheet structure with index tab extending outwardly from the sheet structure.

A further object of my invention to provide such a device that has an index tab portion integral with a tab body that is folded upon itself to form a pocket structure to receive sheet material therein, with a part of the tab body immediately adjacent each surface of such sheet material.

A further object of my invention to provide such a device with the inward body portion having indicia to index a particular area inwardly adjacent the periphery of sheet material to be serviced.

A further object of my invention to provide such a device that has a semi-circularly shaped index tab with curvature at the point of contact between the tab and sheet material being serviced to decrease the probability of the tab's causing or aiding tearing of the periphery of that sheet material.

A further object of my invention to provide such a device that may be formed of transparent material to allow reading of matter thereunder and one that may be provided with colored striping to aid in indicating proper positioning of the device on a sheet.

A further object of my invention to create such a device that is so formed as to aid its proper alignment and maintenance on a serviced sheet and one that tends to distribute forces created by an associated clip over a larger area than they would be distributed over if the same paper clip were used without the device.

A still further object of my invention to provide such a device with a tab that may be pre-marked or marked by a user at the time of use and still may have preprinted advertising material established thereon without affecting its function.

A still further object of my invention to provide such a device that is of new and novel design, of rugged and durable nature, of simple and economic manufacture and one that is otherwise well suited to the uses and purposes for which it is intended.

Other and further objects of my invention will appear from the following specifications and accompanying drawings which form a part hereof. In carrying out the objects of my invention, however, it is to be understood that its features are susceptible to changes in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout:

FIG. 1 is an orthographic surface view of the preferred embodiment of my invention on a partially cutaway sheet, showing its various parts, their configuration and relationship.

FIG. 2 is a somewhat enlarged, orthographic surface view of the device of FIG. 1.

FIG. 3 is an orthographic side view of the device of FIG. 2, taken from the right side of FIG. 2.

FIG. 4 is an orthographic plan view of my indexing tab structure in a flat, unfolded condition.

FIG. 5 is an orthographic surface view of a species of the device of FIG. 2.

FIG. 6 is an orthographic cross-sectional view of the device of FIG. 5, taken on the line 5—5 thereon, in the direction indicated by the arrows, to show the internal structure of the device.

FIG. 7 is an orthographic surface view of an ordinary, retentently deformable, wire-type paper clip of present day commerce preferred for use with my invention.

DESCRIPTION OF THE PREFERRED EMBODIMENT

My invention provides a relatively thin, elongate indexing tab comprising tab body 10, and protruding index tab 11 associated with clip 12 to form a structure releasably positionable on sheet material.

The terms "inner" and "outer" when used to describe my indexing tab hereinafter are used with their ordinary meaning when referring to surfaces but in referring to a direction relative to my tab "inner" refers to the pointed end of the device and "outer" refers to the opposite or protruding semi-circular index tab end, both words gaining their meaning from the position of the device relative to a sheet of paper.

Tab body 10 is an elongate strip having a length greater than its width, in the instance illustrated approximately three and one half times greater. As shown particularly in FIG. 4, tab body 10 is divided into lower portion 13, medial portion 14 and inner portion 15 by folds 16 and 17. The outer and medial body portions are approximately square and inner portion 15 is somewhat longer than wide with its end part preferably configured to form point 18 as illustrated.

If transparent material be used to form tab body 10, preferably two lines 19, 20 are established on the surface of the tab body, line 19 at a spaced distance inwardly of the fold 16 and the line 20 spacedly inwardly of a line through the intersections of side edges of point 18 with the rectilinear sides of inner body portion 15.

The protruding portion of index tab 11 comprises semi-circular element 21 and preferably is formed integrally with tab body 10. Diameter 22 of the semi-circular element is coincident with the outer edge of outer portion 13 of the tab body. The medial part of semi-circular element 21 defines clip sort 23, formed in a hemispherical shape in the instance illustrated in FIG. 4, with appropriate dimension to receive a clip.

Preferably both tab body 10 and protruding index tab 11 are formed to the configuration described from a single sheet of reasonably durable, semi-rigid, transparent material such as a sheet plastic. The material should be somewhat deformable by folding. Preferably at least one surface of protruding tab 11 will be provided with some sort of material that will readily accept marking by ordinary writing instruments such as by painting with a non-glossy, flat surface paint, etching, covering with paper or the like.

Obviously the tab may, if desired, be formed from opaque material and still provide many of the advantages of the principal species of my invention. If such material be used I prefer paper generally of the so-called 'Kraft' type.

Clip 12, as shown particularly in FIG. 7, is the ordinary continuous bent wire type paper clip of ordinary present day commerce, providing larger outer loop 24, medial loop 25 and smaller outer loop 26 with ends 27 in a medial position relative to the entire clip. The dimensions of my tab 10, 11 are preferably related to those of a paper clip to be associated with it so that the length of portions 13 and 14 are approximately equal to the longer dimension of the paper clip, though this dimensioning is not essential.

To assemble my device, a tab as illustrated in FIG. 4 is formed from a flat sheet of material according to the foregoing specification with elongate tab body 10, protruding index tab 11, lines 19, 20 and clip slot 23. The tab is then folded to form the structure illustrated in FIGS. 2 and 3. To accomplish this, with the flat tab structure in the position illustrated in FIG. 4, the inner and medial body portions 14, 15 are folded on line 16 upwardly so that their original upper surface will then be lowermost and adjacent the uppermost surface of outer body portion 13 and protruding tab 11. Inner body portion 15 is then, again, folded away from protruding tab 11, along fold 17 until it, again, rests against the surface of medial body portion 14 with pointed part 18 extending therebeyond. Medial loop 23 of paper clip 12 is then inserted through clip slot 23 in index tab 11. The device is then assembled for use as illustrated.

This assemblage may be accomplished in the manufacturing stage so that the device is ready for use when distributed to the ultimate consumer, or if desired the device might be quite readily formed in the flat fashion illustrated in FIG. 4 and sold in that condition to be finally assembled by a user.

A specie of my invention is shown in the illustrations of FIGS. 5 and 6. This device is quite similar to that illustrated in FIGS. 2, 3 and 4 but differs from that primary mode of my invention in that its paper clip slot **21*a* is formed as a "V" rather than a semi-circle and the innermost portion 14*a*** of the tab body is formed as a semi-circle rather than as a point. This specie is somewhat more simple to manufacture, but may not serve all the purposes of the primary tab.

To use my device, as illustrated in FIG. 1, after assemblage it is merely inserted by appropriate manual manipulation over the peripheral portion of a sheet structure such as paper 29 illustrated. The paper is positioned in pocket 28 defined between the adjacent surfaces of inner body portion 15 and medial body portion 14 with paper clip 12 in communication with the outer surfaces of the tab but not communicating at all with paper 29. When my invention is so positioned it is to be noted that fold 17 will be parallel to and immediately adjacent peripheral edge 30 of sheet 29 and will because of this association tend to align the tab on the sheet and properly position it relative thereto.

It should be noted that inner part 18, 18*a* of the tab will be immediately adjacent the surface of sheet 29 and at a spaced distance inwardly from the peripheral edge, so that it may be used as an indicator, such as to indicate a line of printing, by appropriate positioning of the tab relative to the page.

It should also be noted that with the positioning of lines 19, 20 as indicated they will appear parallel and at a spaced distance apart when used on a transparent body tab as illustrated in FIG. 2, but when the tab is properly inserted on an opaque sheet, such as paper 29, one line will be outwardly of each surface of the sheet so that this feature may be used to determine proper positioning of a sheet within pocket 28; that is, if after the device is positioned one line is visible, the positioning is proper but if no line or two lines are visible the positioning is not proper.

It should also be noted that though the use of my invention is described as with one sheet of paper it might be just as readily used with several sheets that are at least somewhat aligned at the point of use of my tab and when used in this fashion the index tab structure may also serve the ordinary functions of a paper clip as well as an index tab.

It is further to be noted that neither end 27 of paper clip 12 will be in immediate adjacency with either surface of sheet 29 but rather some part of the body of my tab will be between either of those clip ends and the sheet so that the clip ends will be prevented from catching and tearing sheet 29, especially during the removal operation, as is common when ordinary paper clips are removed from a sheet of paper. The physical properties of the material from which tab body 10 is constructed are appropriate to prevent or substantially nullify any probability of such tearing.

It is further to be noted that when my tab is in an assembled position the adjacent surfaces of outer part 13 and medial part 14 might be adhered to insure positional maintenance about fold 16, but generally this fold will be maintained by paper clip 12 when properly positioned and adhesion is not generally necessary.

The foregoing description of my invention is necessarily of a detailed nature so that a specific embodiment of it might be set forth as required, but it is to be understood that various modifications of detail, rearrangement and multiplication of parts, might be resorted to without departing from its spirit, essence or scope.

Having thusly described my invention, what I desire to protect by Letters Patent, and

What I claim is:

1. A releasably positionable index tab clip comprising in combination:
   - an elongate tab body, twice folded upon itself to form a pocket between two folded portions to receive sheet material with
     - an index tab structurally communicating with and extending outwardly from one end of the tab body on only one side of associated sheet material and defining
     - a clip slot in the medial portion of the index tab; and
   - a retentably deformable, ordinary commercial bent wire paper clip carried in the clip slot with a portion of the clip on each side of at least part of the folded portions of the tab body forming a pocket.

2. The invention of claim 1 further characterized by:
   - the index tab being of semi-circular configuration with a diameter equal to the width of the tab body, and
   - the inner portion of the tab body most distal from the index tab being configured as a point.

3. The invention of claim 1 having at least the tab body formed of transparent material.

4. The invention of claim 1 having two spaced parallel lines, one of said lines defined on parts of the tab body on each side of the pocket formed thereby.

5. A releasably positionable index tab clip for use with sheet material comprising, in combination:
   - an elongate tab body formed of a unitary sheet of transparent material and defining in sequential order a semi-circular protruding index tab, an outer body portion, a medial body portion and an inner body portion with a pointed end part,
     - said tab body being folded upon itself with the medial body portion immediately adjacent the outer body portion and the inner body portion immediately adjacent the medial body portion to define a pocket between the inner and medial body portion, and
     - a clip slot defined in the medial part of the protruding index tab, and
   - a retentently deformable bent wire paper clip carried in the clip slot with a portion of the paper clip on the outer surfaces of each of the outermost sides of the folded portion of tab body.

6. The invention of claim 5 having a first line defined on the medial body portion and a second line defined on the pointed portion of the body to aid in determining positioning of the device on opaque sheet material.

* * * * *